US010655852B2

(12) United States Patent
Kuchiki et al.

(10) Patent No.: US 10,655,852 B2
(45) Date of Patent: May 19, 2020

(54) SHIP HAVING PLURALITY OF FUEL LINES

(71) Applicant: MITSUBISHI SHIPBUILDING CO., LTD., Yokohama-shi, Kanagawa (JP)

(72) Inventors: Yusuke Kuchiki, Tokyo (JP); Shingen Takeda, Tokyo (JP); Hiroshi Tamura, Tokyo (JP); Masahiko Mino, Tokyo (JP); Koichi Okuda, Tokyo (JP)

(73) Assignee: MITSUBISHI SHIPBUILDING CO., LTD., Yokohama-Shi, Kanagawa (JP)

( * ) Notice: Subject to any disclaimer, the term of this patent is extended or adjusted under 35 U.S.C. 154(b) by 0 days.

(21) Appl. No.: 16/318,947

(22) PCT Filed: Jun. 14, 2017

(86) PCT No.: PCT/JP2017/021921
§ 371 (c)(1),
(2) Date: Jan. 18, 2019

(87) PCT Pub. No.: WO2018/078945
PCT Pub. Date: May 3, 2018

(65) Prior Publication Data

US 2019/0285273 A1 Sep. 19, 2019

(30) Foreign Application Priority Data

Oct. 31, 2016 (JP) ..... 2016-213211

(51) Int. Cl.
*F23K 5/04* (2006.01)
*B63B 11/02* (2006.01)
(Continued)

(52) U.S. Cl.
CPC ..... *F23K 5/04* (2013.01); *B63B 11/00* (2013.01); *B63B 11/02* (2013.01);
(Continued)

(58) Field of Classification Search
CPC ..... B63B 11/00; B63B 11/02; B63H 21/14; B63H 21/16
See application file for complete search history.

(56) References Cited

U.S. PATENT DOCUMENTS 1,944,242 A * 1/1934 Johnson ..... B63B 11/02 440/33
2008/0141921 A1* 6/2008 Hinderks ..... B63B 1/28 114/274
2019/0285273 A1* 9/2019 Kuchiki ..... B63H 21/38

FOREIGN PATENT DOCUMENTS

JP 2005-241476 A 9/2005
JP 2015-209188 A 11/2015
(Continued)

OTHER PUBLICATIONS

PCT/ISA/210, "International Search Report for International Application No. PCT/JP2017/021921," dated Jul. 11, 2017.
(Continued)

*Primary Examiner* — S. Joseph Morano
*Assistant Examiner* — Jovon E Hayes
(74) *Attorney, Agent, or Firm* — Manabu Kanesaka

(57) ABSTRACT

This ship includes a ship body, a fuel tank chamber, a stern-side engine room, a bow-side engine room, a main fuel line and a sub-fuel line, and a pump mechanism. The main fuel line connects a fuel tank, a stern-side power generation unit, and a bow-side power generation unit through the bow-side engine room. The sub-fuel line connects at least the fuel tank and the stern-side power generation unit, and is disposed through a section different from the bow-side engine room through which the main fuel line passes. The pump mechanism selectively feeds fuel into the main fuel line or the sub-fuel line from the fuel tank.

7 Claims, 11 Drawing Sheets

(51) Int. Cl.

| | |
|---|---|
| ***B63B 17/00*** | (2006.01) |
| ***B63H 21/38*** | (2006.01) |
| ***B63J 3/04*** | (2006.01) |
| ***B63H 21/16*** | (2006.01) |
| ***B63B 11/00*** | (2006.01) |
| *B63H 21/14* | (2006.01) |

(52) U.S. Cl.
CPC ..... *B63B 17/0027* (2013.01); *B63H 21/16* (2013.01); *B63H 21/38* (2013.01); *B63J 3/04* (2013.01); *B63H 21/14* (2013.01)

(56) References Cited

FOREIGN PATENT DOCUMENTS

| | | | |
|---|---|---|---|
| KR | 10-2012-0133690 | A | 12/2012 |
| KR | 10-2015-0031648 | A | 3/2015 |

OTHER PUBLICATIONS

PCT/ISA/237, "Written Opinion of the International Searching Authority for International Application No. PCT/JP2017/021921," dated Jul. 11, 2017.

* cited by examiner

SHIP HAVING PLURALITY OF FUEL LINES

TECHNICAL FIELD

This invention relates to a ship having a plurality of fuel lines.

Priority is claimed on. Japanese Patent Application No. 2016-213211, filed on Oct. 31, 2016, the content of which is incorporated herein by reference.

BACKGROUND ART

The revision of the SOLAS convention in 2009 has demanded that a passenger ship ensures a required restoring force and navigates to a port by herself, even in a case where the ship is flooded or a fire breaks out due to damage to the ship.

For example, PTL 1 discloses a configuration which improves restoring ability as follows. The center of gravity of the ship is lowered by allowing water entering the inside of a ship body at the time of damage to flow into a space disposed in a bottom portion of the ship body.

CITATION LIST

Patent Literature

[PTL 1] Japanese Unexamined Patent Application Publication No. 2015-209188

SUMMARY OF INVENTION

Technical Problem

According to the above-described ship, in order to ensure self-navigation ability, a configuration including a plurality of engine rooms has been studied. The respective engine rooms accommodate a main machine needed to obtain a propulsion force of the ship or a power source such as a generator for generating electric power to drive a propeller. The plurality of engine rooms are partitioned using a bulkhead having fire protection performance and water-tightness. In a case where a fire breaks out or there is a flood in any one of the engine rooms, the power source of the engine room having no fire or flood is operated. In this manner, the ship can continuously perform self-navigation.

In a configuration including the plurality of engine rooms in this way, it is necessary to supply a fuel to the power source of at least one engine room out of the plurality of engine rooms, even in a state where there is the fire or the flood. Therefore, for example, in some cases, fuel tanks are respectively disposed on a bow side and a stern side for the plurality of engine rooms which are longitudinally arranged parallel to each other in a bow-stern direction.

However, according to the configuration in which the fuel tanks are respectively disposed on the bow side and the stern side for the plurality of engine rooms which are longitudinally arranged parallel to each other in the bow-stern direction, for example, in a case where the fuel tank located on the bow side cannot be used due to the fire or the flood, a fuel tank chamber on the stern side needs to store a sufficient amount of the fuel in order for the snip to call at a port by herself by consuming only the fuel stored in the fuel tank. Accordingly, this leads to an increase in a size of the fuel tank to be accommodated in the fuel tank chamber located on the stern side.

However, an some cases, a stern part of the ship body may be less likely to be equipped with the fuel tank having a large size due to the following reasons. It is necessary to secure an installation space of the propeller in the stern part, or the ship body has a shape which is narrowed from the bow side toward the stern side.

This invention provides a ship having a plurality of fuel lines capable of performing self-navigation even when there is a fire or a flood, and capable of effectively utilizing a space inside a ship body.

Solution to Problem

According to a first aspect of this invention, there is provided a ship having a plurality of fuel lines. The ship includes a ship body, a fuel tank chamber, a first engine room, a second engine room, a first fuel line, a second fuel line, and a pump mechanism. The fuel tank chamber is disposed inside the ship body, and is partitioned by a bulkhead so as to accommodate a fuel tank. The first engine room is disposed inside the ship body, and is partitioned by the bulkhead so as to accommodate a first combustion engine for combusting a fuel supplied from the fuel tank. The second engine room is disposed between the fuel tank chamber and the first engine room inside the ship body, and is partitioned by the bulkhead so as to accommodate a second combustion engine for combusting the fuel supplied from the fuel tank. The first fuel line connects the fuel tank to the first combustion engine and the second combustion engine through the second engine room. The second fuel line connects at least the fuel tank and the first combustion engine to each other, and is located through a partitioned section different from the second engine room through which the first fuel line passes. The pump mechanism selectively feeds the fuel from the fuel tank to either the first fuel line or the second fuel line.

In this way, the first fuel line and the second fuel line pass through the mutually different partitioned sections between the fuel tank chamber and the first engine room. In this manner, even if there is a fire or a flood in the second engine room through which the first fuel line passes, a fuel can be supplied to the first combustion engine disposed in the first engine room through the second fuel line. According to this configuration, the ship can continuously perform self-navigation.

Furthermore, the first engine room does not necessarily need to include the fuel tank located on a side opposite to the second engine room.

According to a second aspect of this invention, the pump mechanism according to the first aspect may include a first pump and a second pump. The first pump is disposed in the first fuel line. The second pump is disposed in the second fuel line. The first pump and the second pump may be arranged in mutually different partitioned sections.

According to this configuration, in a case where there is a fire or a flood in the partitioned section having toe first pump, toe second pump is not affected. Therefore, the fuel can be supplied to the first combustion engine through the second fuel line.

According to a third aspect of this invention, the fuel tank chamber according to the first or second aspect may include a first fuel tank chamber and a second fuel tank chamber which are partitioned by the bulkhead so as to respectively accommodate the fuel tanks. The first fuel line may be connected to the fuel tank disposed in the first fuel tank chamber out of the first fuel tank chamber and the second fuel tank chamber, and the second fuel line may be connected to the fuel tank disposed in the second fuel tank chamber.

In this way, the first fuel tank chamber and the second fuel tank chamber are separately disposed. In this manner, even if there is a fire or a flood in the first fuel tank chamber or the second fuel tank chamber, the fuel supply is not interrupted. Therefore, the ship can continuously perform the self-navigation.

According to a fourth aspect of this invention, the fuel tank chamber according to any one of the first to third aspects may be located on a bow side in a bow-stern direction of the ship body with respect to the second engine room.

In this way, the fuel tank chamber is located on the bow side in the bow-stern direction of the first engine room and the second engine room. In this manner, it is no longer necessary to dispose the fuel tank chamber on the stern side in the bow-stern direction of the first engine room and the second engine room. Compared to a case where the fuel tank chamber is disposed on the stern side which is likely to receive space restrictions, the larger fuel tank can be installed.

Furthermore, the fuel tank chamber is not disposed on the stern side. Accordingly, it is possible to prevent the center of gravity of the ship body in the bow-stern direction from being biased toward the stern side. In this manner, it is no longer necessary to dispose ballast on the bow side in order to keep a balance in the bow-stern direction of the ship body. Therefore, it is possible to prevent the ship body from increasing in weight, and thus, it is possible to contribute to improved fuel efficiency of the ship.

Furthermore, the fuel tank chamber is not disposed on the stern side. Accordingly, the fuel tank chamber, the first engine room, and the second engine room can be laid out close to the stern side. In this manner, a space inside the ship body can be effectively utilized.

According to a fifth aspect of this invention, the first fuel line according to any one of the first to fourth aspects may include on-off valves disposed on both sides across a position where the first fuel line penetrates, the bulkhead.

According to this configuration, the on-off valve is closed in the partitioned section adjacent to the partitioned section where there is a fire. In this manner, through the first fuel line, the fuel cannot pass through the portioned section where there is the fire.

According to a sixth aspect of this invention, the second fuel line according to any one of the first to fifth aspects may be located so as to pass through the partitioned section adjacent to the second engine room in a ship width direction or an upward-downward direction of the ship body.

According to this configuration, it is possible to minimize a length of the second fuel line by preventing the second fuel line from taking a roundabout route.

According to a seventh aspect of this invention, the second fuel line according to the sixth aspect may be located so as to pass through the fuel tank chamber, the first engine room, and a ship bottom partitioned section formed below the second engine room.

In this way, the second fuel line passes through the ship bottom partitioned section. Accordingly, it is possible to prevent a possibility that the second fuel line may cause damage to a cargo space inside the ship body or a space for installing various devices. In this manner, the space inside the ship body can be effectively utilized.

Advantageous Effects of Invention

According to the above-described ship having the plurality of fuel lines, even if there is a fire or a flood, the ship can perform the self-navigation, and the space inside the ship body can be effectively utilized.

DESCRIPTION OF EMBODIMENTS

Hereinafter, a ship having a plurality of fuel lines according to embodiment of this invention will be described with reference to the drawings.

First Embodiment

Figure 1:
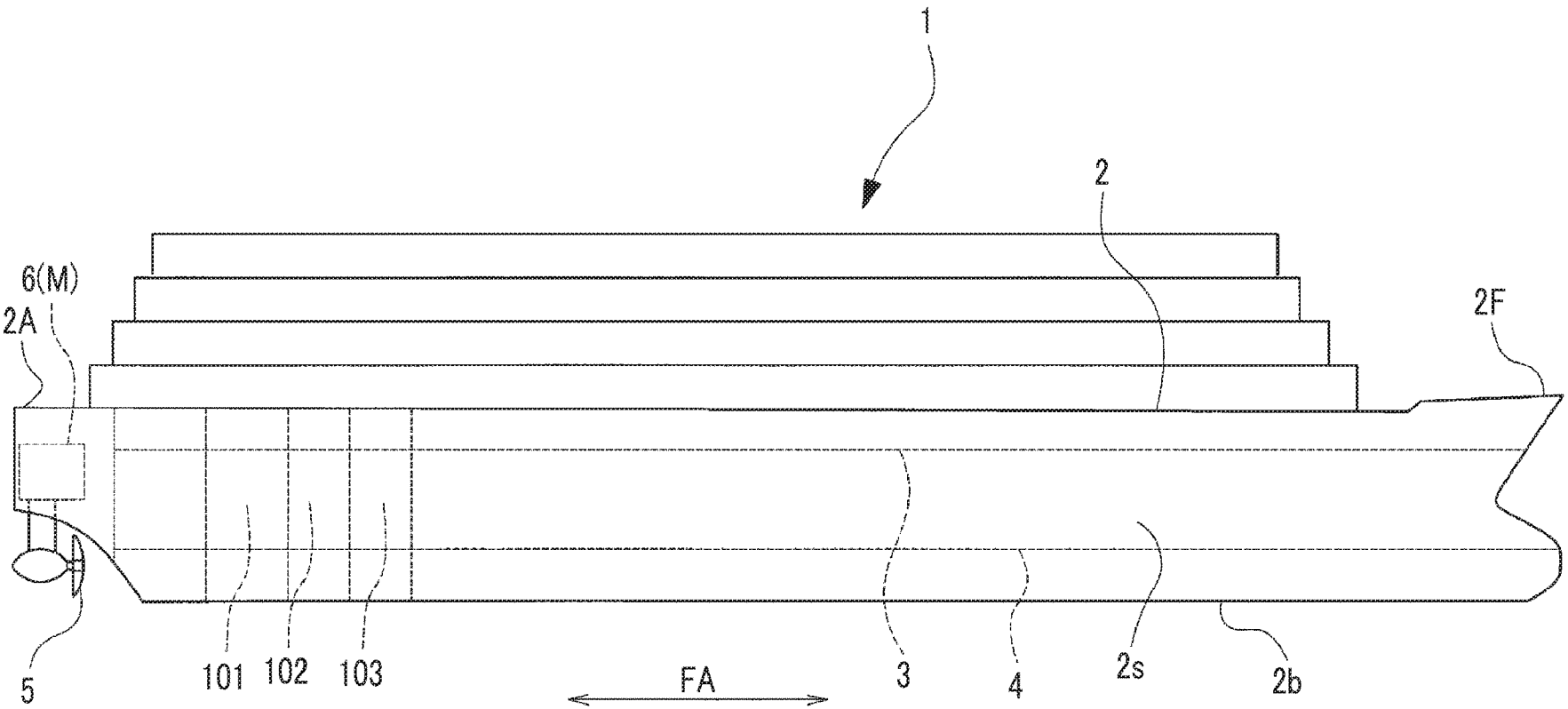
FIG. 1 is a side view of a ship according to an embodiment of this invention.
Figure 2:
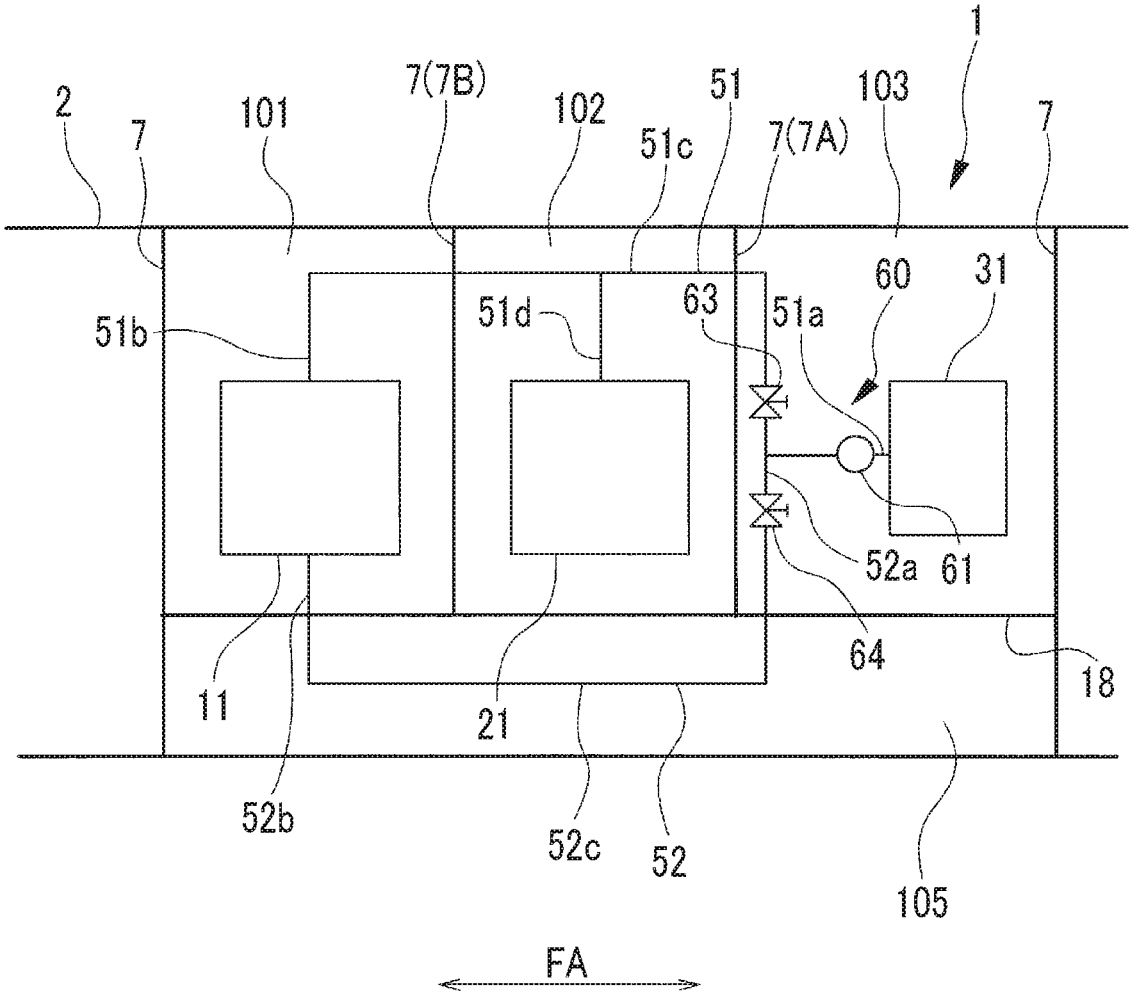
FIG. 2 is a block diagram illustrating a minimum configuration of a ship according to a first embodiment of his invention.

FIG. 1 is side view of a ship according to an embodiment of this invention. FIG. 2 is a block diagram illustrating a minimum configuration of a ship according to a first embodiment of this invention.

As illustrated in FIGS. 1 and 2, a ship 1 includes a ship body 2, a stern-side engine room. (first engine room) 101, a bow-side engine room (second engine room) 102, a fuel tank chamber 103, a main fuel line (first fuel line) 51, a sub-fuel line (second fuel line) 52, and the pump mechanism 60. Here, the ship 1 will be described as a passenger ship. However, a type of the ship to which this invention is applicable is not limited to a specific one. For example, this invention can adopt various types of the snip, such as a ferry, a roll-on/roll-off ship (RORO ship), and a pure car & truck carrier (PCTC).

As illustrated in FIG. 1, the ship body 2 has a pair of ship sides 2*s* disposed on both sides in a ship width direction, and a ship bottom 2*b*. The ship body 2 includes a freeboard deck 3 disposed at an interval above the ship bottom 2*b*. The ship body 2 further includes a deck 4 disposed between the ship bottom 2*b* and the freeboard deck 3 so as to form a double bottom.

The ship body includes a screw 5 below the ship bottom 2*b* of a stern 2A. The screw 5 is rotationally driven by a propeller 6 disposed inside the ship body 2. The ship 1 according to this embodiment employs an electric motor M for the propeller 6.

A stern-side engine room 101 and a bow-side engine room 102 are disposed on the deck 4 inside the ship body 2. The stern-side engine room 101, the bow-side engine room 102, and the fuel tank chamber 103 are sequentially arranged from the stern 2A side to a bow 2F side in a bow-stern direction FA.

As illustrated in FIG. 2, the bow-side engine room 102, the stern-side engine room 101, and the fuel tank chamber 103 are respectively partitioned from each other by transverse bulkheads (bulkheads) 7 disposed at an interval in the bow-stern direction FA.

The stern-side engine room 101 internally accommodates a stern-side power generation unit (first combustion engine) 11. The stern-side power generation unit 11 mainly includes an internal combustion engine unit (not illustrated) such as a gas turbine and a diesel engine, and a power generator unit (not illustrated). The stern-side power generation unit 11 drives the power generator unit by causing the internal combustion engine unit to combust a fuel supplied from a fuel tank 31 (to be described later). In this manner, electric power is output to the propeller 6 (electric motor M) and each unit inside the ship.

The bow-side engine room 102 is disposed between the fuel tank chamber 103 and the stern-side engine room 101 inside the ship body 2. The bow-side engine room 102 internally accommodates a bow-side power generation unit (second combustion engine) 21. The bow-side power generation unit 21 mainly includes an internal combustion engine unit (not illustrated) such as a gas turbine and a diesel engine, and a power generator unit (not illustrated) The bow-side power generation unit 21 drives the power generator unit by causing the internal combustion engine unit to combust the fuel supplied from the fuel tank 31. In this manner, the electric power is output to the propeller 6 (electric motor M) and each unit inside the ship.

The fuel tank chamber 103 is located on the how 2F side in the bow-stern direction FA of the ship body 2 with respect to the stern-side engine room 101 and the bow-side engine room 102. The fuel tank chamber 103 internally accommodates a fuel tank 31. The fuel tank 31 stores the fuel to be combusted by the stern-side power generation unit 11 and the bow-side power generation unit 21.

A main fuel line 51 supplies the fuel stored in the fuel tank 31 to the stern-side power generation unit 11 and the bow-side power generation unit 21. The main fuel line 51 is disposed so as to connect the fuel tank 31, the stern-side power generation unit 11, and the bow-side power generation unit 21 to each other. A first end portion 51*a* of the main fuel line 51 is connected to the fuel tank 31 inside the fuel tank chamber 103. A second end portion 51*b* of the main fuel line 51 is connected to the stern-side power generation unit 11 inside the stern-side engine room 101.

The main fuel line 51 penetrates transverse bulkhead 7A disposed between the fuel tank chamber 103 and the bow-side engine room 102 and a transverse bulkhead 7B disposed between the bow-side engine room 102 and the stern-side engine room 101. In this manner, in the main fuel line 51, an intermediate portion 51*c* disposed between the first end portion 51*a* and the second end portion 51*b* passes through the inside of the bow-side engine room 102. The main fuel line 51 is connected to the bow-side power generation unit 21 via a branch pipe 51*d* disposed by being branched from the intermediate portion 51*c* inside the bow-side engine room 102.

A sub-fuel line 52 supplies the fuel stored in the fuel tank 31 to the stern-side power generation unit 11. In the sub-fuel line 52, a first end portion 52*a* is connected to the main fuel line 51 inside the fuel tank chamber 103. In the sub-fuel line 52, a second end portion 52*b* is connected to the stern-side power generation unit 11 inside the stern-side engine room 101.

The sub-fuel line 52 is located so that an intermediate portion 52*c* disposed between the first end portion 52*a* and the second end portion 52*b* passes through a partitioned section 105 different from the stern-side engine room 101 through which the main fuel line 51 passes. For example, the partitioned section 105 is separated from the bow-side engine room 102, the stern-side engine room 101, and the fuel tank chamber 103 by a bulkhead 18 having fire protection performance and water-tightness. The partitioned section 105 is adjacent to the bow-side engine room 102 in the ship width direction or the upward-downward direction.

The pump mechanism 60 includes a pump 61 and on-off valves 63 and 64.

The pump 61 pumps the fuel stored inside the fuel tank 31. The on-off valves 63 and 64 are disposed in the main fuel line 51 and the first end portion 52*a* of the sub-fuel line 52 on a downstream side of the pump 61. The pump 61 and the on-off valves 63 and 64 are arranged inside the fuel tank chamber 103 together with the fuel tank 31.

The pump mechanism 60 configured in this way operates the pump 61 and opens the on-off valve 63 or the on-off valve 64. In this manner, the pump mechanism 60 can selectively feed the fuel from the fuel tank 31 to either the main fuel line 51 or the sub-fuel line 52.

During normal navigation, the ship 1 configured in this way closes the on-off valve 64 of the sub-fuel line 52. The pump 61 supplies the fuel stored in the fuel tank 31 to each of the bow-side power generation unit 21 inside the bow-side engine room 102 and the stern-side power generation unit 11 inside the stern-side engine room 101 through the main fuel line 51.

In the ship 1, in a case where there is a fire or a flood in the bow-side engine room 102, the on-off valve 63 of the main fuel line 51 is closed, and the on-off valve of the sub-fuel line 52 is open. Then, the pump 61 supplies the fuel stored in the fuel tank 31 to the stern-side power generation unit 11 inside the stern-side engine room 101 through the sub-fuel line 52.

The ship 1 according to the first embodiment is configured so that the sub-fuel line 52 passes through the partitioned section 105 different from the bow-side engine room 102 through which the main fuel line 51 passes, between the fuel tank chamber 103 and the stern-side engine room 101. In this manner, even if there is the fire or the flooding in the bow-side engine room 102 through which the main fuel line 51 passes, the fuel can be supplied to the stern-side power generation unit 11 disposed in the stern-side engine room 101 through the sub-fuel line 52. Therefore, the ship 1 can continuously perform self-navigation.

Furthermore, the stern-side engine room 101 does not necessarily need to include the fuel tank 31 located on a side opposite to the bow-side engine room 102, that is, in a stern section. Therefore, the space inside the ship body 2 can be effectively utilized.

Furthermore, the fuel tank chamber 103 is located on the bow 2F side with respect to the stern-side engine room 101 and the bow-side engine room 102. In this manner, it is no longer necessary to dispose the fuel tank chamber 103 on the stern 2A side. Therefore, in a case where the engine rooms located on the stern 2A side from the center in the bow-stern direction FA as in the ship 1, compared to a case where the fuel tank chamber 103 is disposed on the stern 2A side from the stern-side engine room 101 which is likely to receive space restrictions, the larger fuel tank 31 can be installed.

Furthermore, the fuel tank chamber 103 is not disposed on the stern 2A side from the stern-side engine room 101. Accordingly, the center of gravity of the ship body 2 in the bow-stern direction FA can be prevented from being biased toward the stern 2A side. In this manner, it is no longer necessary to dispose ballast on the bow 2F side in order to keep a balance in the bow-stern direction FA of the ship body 2. Therefore, it is possible to prevent the ship body 2 from increasing in weight, and thus, it is possible to contribute to improved fuel efficiency of the ship 1.

Furthermore, the fuel tank chamber 103 is not disposed on the stern 2A side from the stern-side engine room 101. Accordingly, the fuel tank chamber 103, the stern-side engine room 101, and the bow-side engine room 102 can be laid out close to the stern 2A side. In this manner, a space on the bow 2F side from the fuel tank chamber 103 inside the ship body 2 can be effectively utilized as a larger cargo space.

The sub-fuel line 52 passes through the partitioned section 105 adjacent in the ship width direction or the upward-downward direction of the bow-side engine room 102.

According to this configuration, it is possible to minimize a length of the sub-fuel line 52 by preventing the sub-fuel line 52 from taking a roundabout route.

Modification Example of First Embodiment

In the above-described first embodiment, a case has been described where the fuel tank chamber 103 is located on the bow 2F side of the bow-side engine room 102. However, the fuel tank chamber 103 may be located on the stern 2A side of the stern-side engine room 101.

Second Embodiment

Next, a second embodiment of the ship according to this invention will be described. In the second embodiment described below, only a configuration of the pump mechanism is different from that according to the first embodiment. Thus, the same reference numerals will be given to elements the same as those according to the first embodiment, and repeated description will be omitted.

Figure 3:
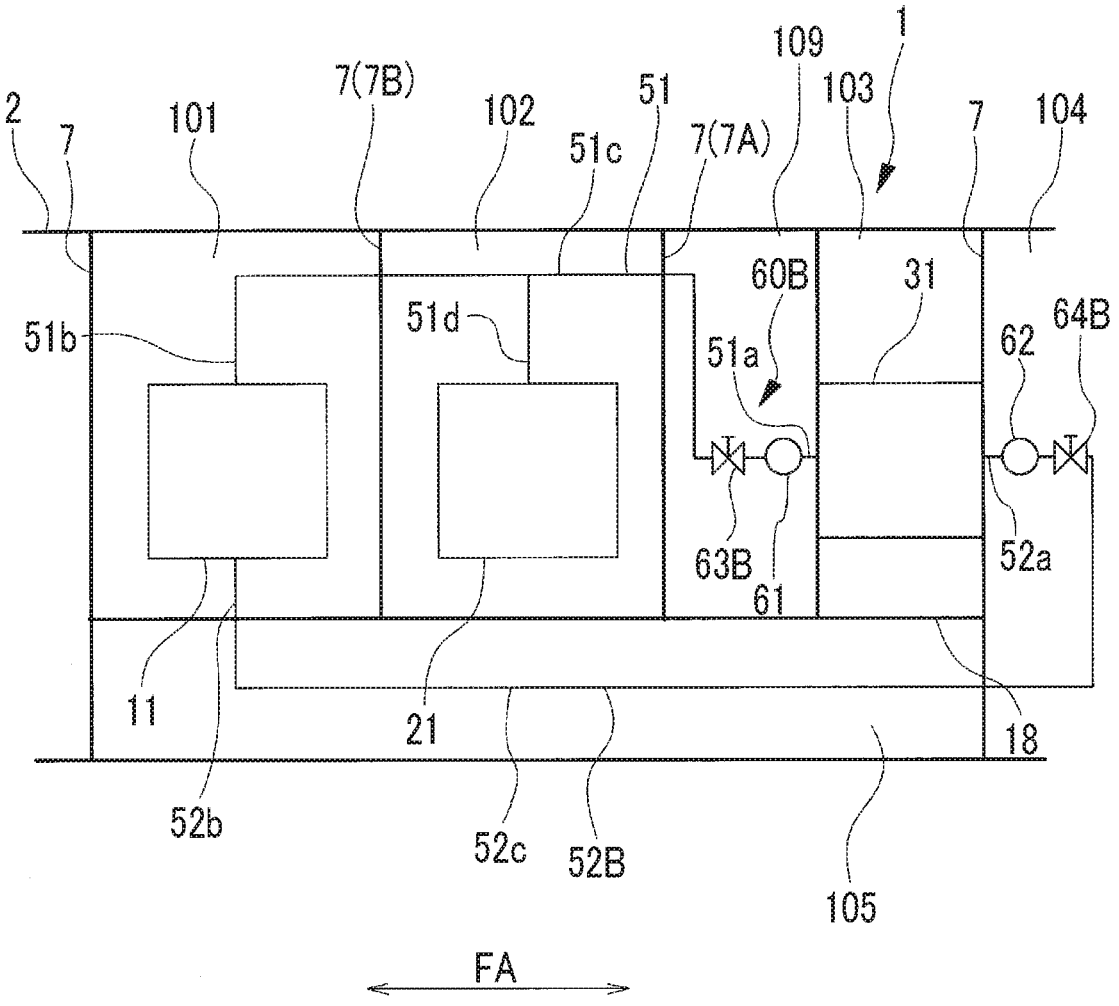
FIG. 3 is a block diagram illustrating a configuration of a ship according to a second embodiment of this invention.

FIG. 3 is a block diagram illustrating a configuration of the ship according to the second embodiment of this invention.

As illustrated in FIG. 3, similar to the first embodiment, the ship 1 according to the second embodiment includes the ship body 2, the stern-side engine room 101, the bow-side engine room 102, the fuel tank chamber 103, the main fuel line 51, the sub-fuel line (second fuel line) 52B, and a pump mechanism 60B.

The stern-side engine room 101 accommodates the stern-side power generation unit 11. The bow-side engine room 102 accommodates the bow-side power generation unit 21. The fuel tank chamber 103 accommodates the fuel tank 31.

The main fuel line 51 connects the fuel tank 31 to the stern-side power generation unit 11 and the bow-side power generation unit 21. In the main fuel line 51, the intermediate portion 51*c* disposed between the first end portion 51*a* and the second end portion 51*b* passes through the inside of the bow-side engine room 102.

A sub-fuel line 52B supplies the fuel stored in the fuel tank 31 to the stern-side power generation unit 11. In the sub-fuel line 52B, a first end portion 52*a* is connected to the fuel tank 31. In the sub-fuel line 52B, a second end portion 52*b* is connected to the stern-side power generation unit 11.

The sub-fuel line 52B is located so that an intermediate portion 52*c* disposed between the first end portion 52*a* and the second end portion 52*b* the passes through the partitioned section 104 and the partitioned section 105 which are different from the stern-side engine room 101 through which the main fuel line 51 passes. The partitioned section 104 is adjacent to the fuel tank chamber 103 via the transverse bulkhead 7. For example, the partitioned section 105 is partitioned from the bow-side engine room 102, the stern-side engine room 101, and the fuel tank chamber 103 by the bulkhead 18 having fire protection performance and water-tightness. The sub-fuel line 52B passes through the partitioned section 104 and partitioned section 105 from the first end portion 52*a* connected to the fuel tank 31, and reaches the stern-side engine room 101. The second end portion 52*b* is connected to the stern-side power generation unit 11.

The pump mechanism 60B includes a pump (first pump) 61, a pump (second pump) 62, and on-off valves 63B and 64B.

The pump 61 and 62 pumps the fuel stored inside the fuel tank 31. The pump 61 is disposed in the first end portion 51*a* of the main fuel line 51. The pump 61 is located inside a partitioned section 109 different from the fuel, tank chamber 103. The partitioned section 109 is adjacent to the fuel tank chamber 103 via the transverse bulkhead 7. The pump 62 is disposed in the first end portion 52*a* of the sub-fuel line 52B. Furthermore, the pump 62 is located inside the partitioned section 104.

The on-off valve 63B is disposed in the first end portion 51*a* of the main fuel line 51 on the downstream side of the pump 61. The on-off valve 61B is disposed in the first end portion 52*a* of the sub-fuel line 52 on the downstream side of the pump 62. The on-off valve 64B is located inside the partitioned section 104.

The pump mechanism 60B configured in this way switches operations of the pumps 61 and 62 and opening and closing of the on-off valve 63B and the on-off valve 64B. In this manner, the pump mechanism 60B can selectively feed the fuel from the fuel tank 31 to either the main fuel line 51 or the sup-fuel line 52B.

During normal navigation, the ship 1 configured in this way stops the pump 62 of the sub-fuel line 52B, and closes the on-off valve 64B so that the pump 61 of the main fuel line 51 is operated and the on-off valve 63B is open. In this manner, through the main fuel line 51, the fuel stored in the fuel tank 31 is supplied to the bow-side power generation unit 21 inside the bow-side engine room 102 and the stern-side power generation unit 11 inside the stern-side engine room 101.

Furthermore, in the ship 1, in a case where there is a fire or a flood in the bow-side engine room 102, the pump 61 of the main fuel line 51 is stopped, and the on-off valve 63B is closed so that the pump 62 of the sub-fuel line 52B is operated and the on-off valve 64B is open. Then, through the sub-fuel line 52B, the pump 62 supplies the fuel stored in the fuel tank 31 to the stern-side power generation unit 11 inside the stern side engine room 101.

According to the ship of the above-described second embodiment, the pump mechanism 60B includes the pumps 61 and 62 respectively disposed in the main fuel line 51 and the sub-fuel line 52B. Furthermore, the pump 61 of the main fuel line 51 and the pump 62 of the sub-fuel line 52B are arranged in the mutually different partitioned sections 104 and 105.

According to this configuration, in a case where there is the fire or the flood in the fuel tank chamber 103 or the partitioned section 109 having the pump 61 of the main fuel line 51, the pump 62 of the sub-fuel line 52B is not affected. Therefore, the fuel can be supplied to the stern-side power generation unit 11 through the sub-fuel line 52B.

Similar to the above-described first embodiment, the sub-fuel line 52B passes through the partitioned sections 104 and 105 different from the bow-side engine room 102 through which the main fuel line 51 passes. Therefore, even if there is the fire or the flood in the bow-side engine room 102 through which the main fuel line 51 passes, the ship can continuously perform the self-navigation.

Third Embodiment

Next, a third embodiment of the ship according to this invention will be described. In the third embodiment described below, the same reference numerals will be given to elements the same as those according to the first embodiment, and repeated description will be omitted.

Figure 4:
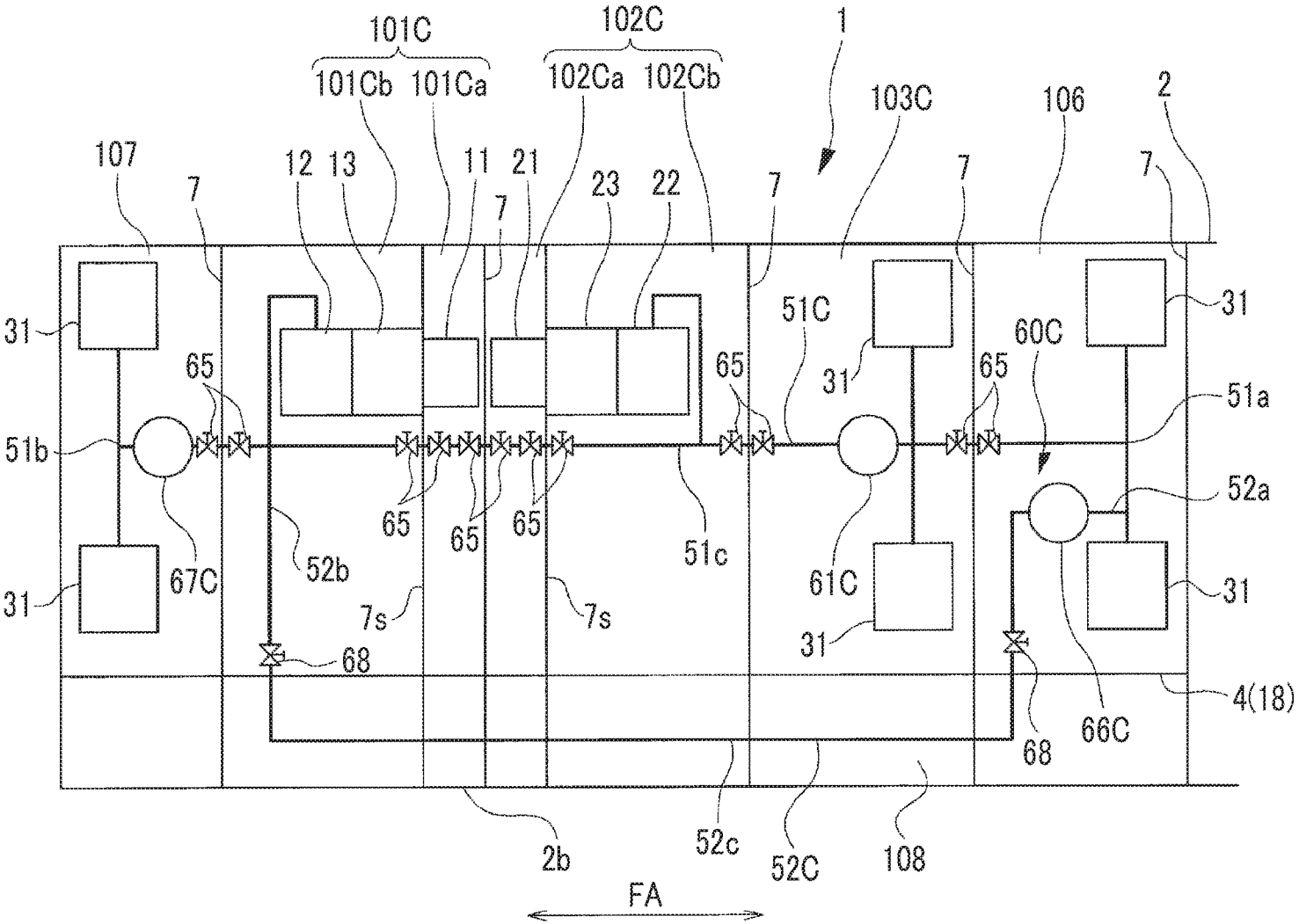
FIG. 4 is a block diagram illustrating a configuration of a ship according to a third embodiment of this invention.
Figure 5:
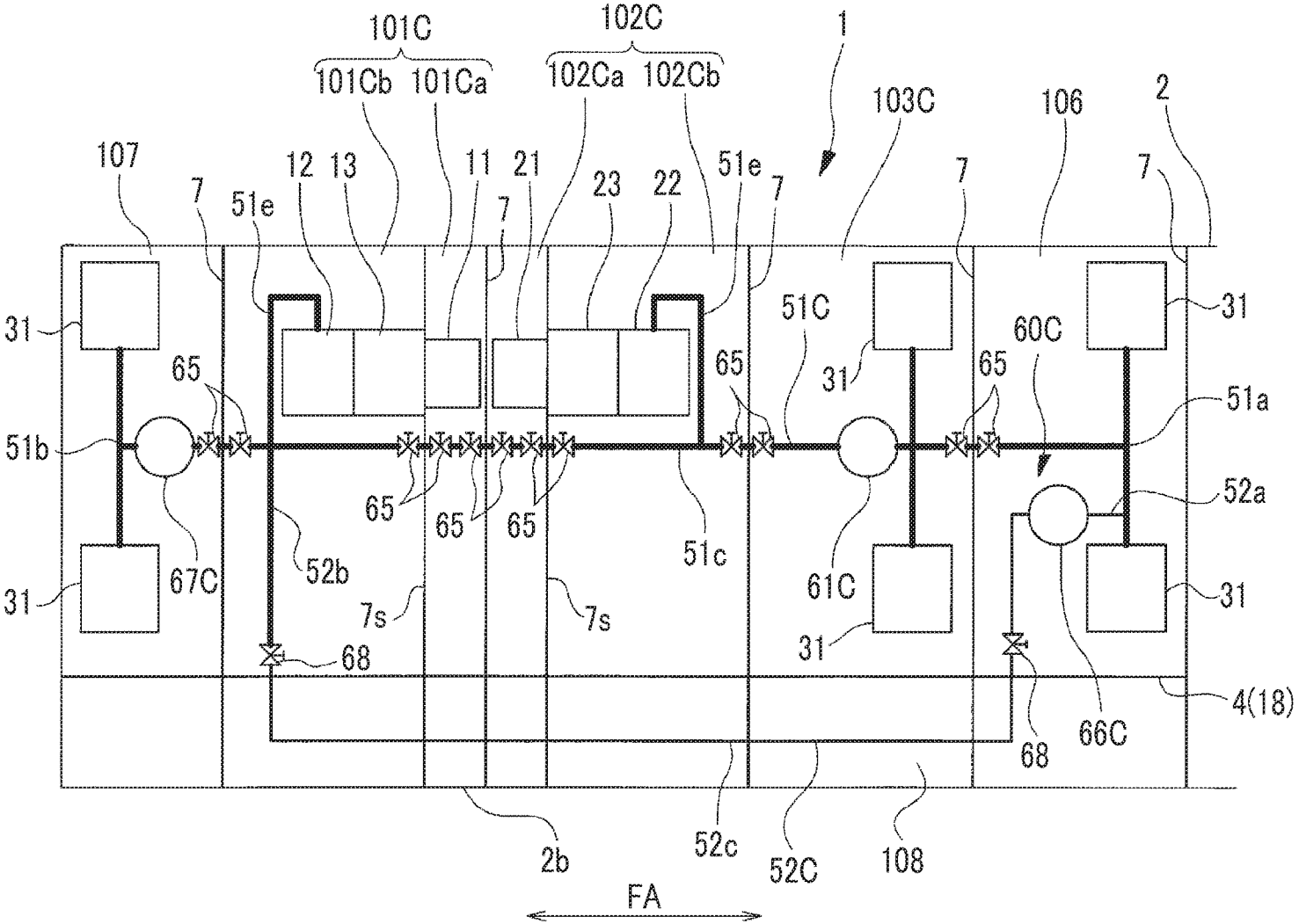
FIG. 5 is a view illustrating a state where a fuel is supplied through a main fuel line according to the third embodiment of this invention.
Figure 6:
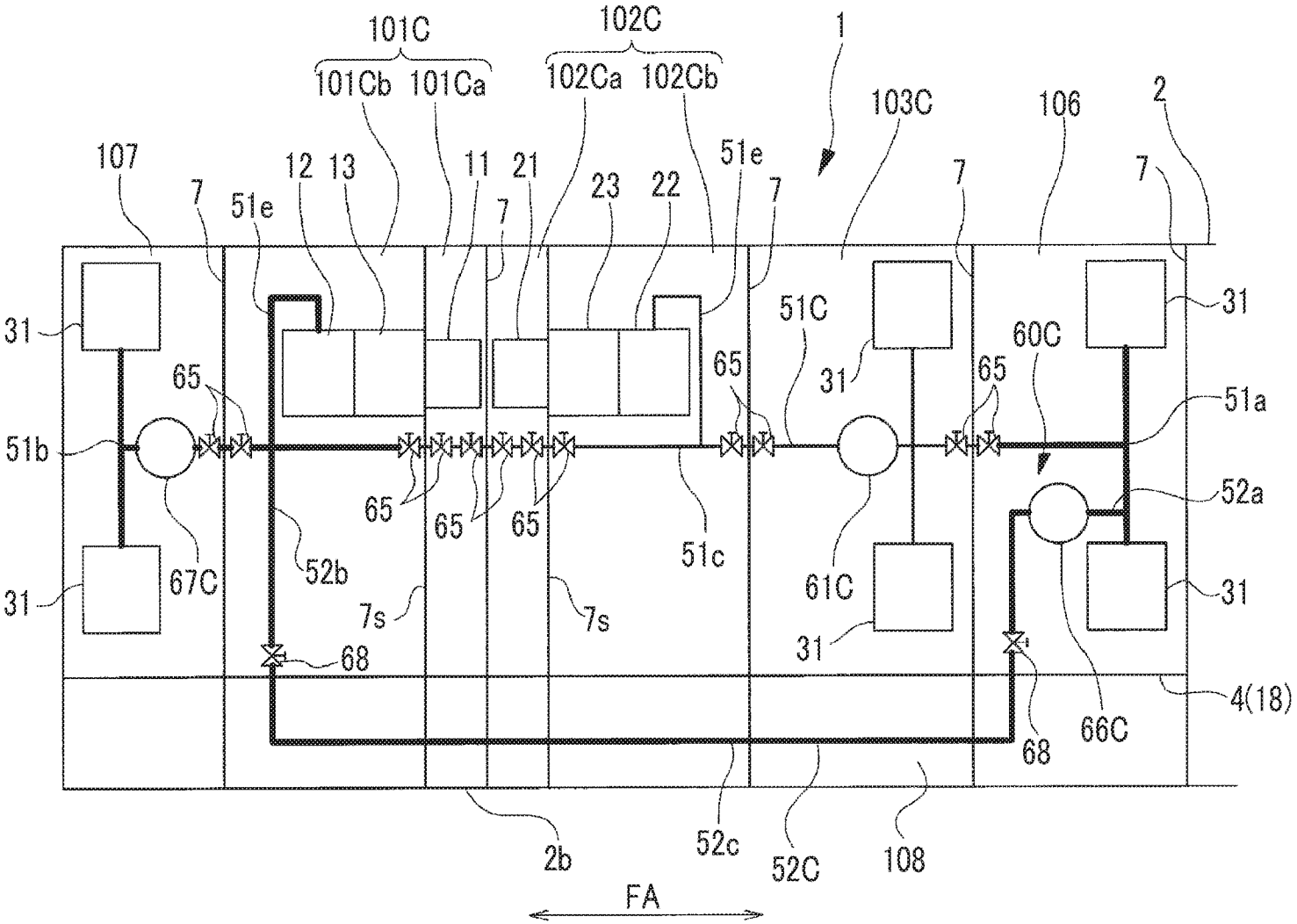
FIG. 6 is a view illustrating a state where the fuel is supplied through a sub-fuel line according to the third embodiment of this invention.

FIG. 4 is a block diagram illustrating a configuration of the ship according to the third embodiment of this invention. FIG. 5 is a view illustrating a state where the fuel is supplied through the main fuel line according to the third embodiment of this invention. FIG. 6 is a view illustrating a state where the fuel is supplied through the sub-fuel line according to the third embodiment of this invention.

As illustrated in FIG. 4, the ship 1 includes the ship body 2, a stern-side engine room (first engine room) 101C, a bow-side engine room (second engine room) 102C, a first bow-side fuel tank chamber (first fuel tank chamber) 103C, a second bow-side fuel tank chamber (second fuel tank chamber) 106, the stern-side fuel tank chamber 107, a main fuel line (first fuel line) 51C, a sub-fuel line (second fuel line) 52C, and a pump mechanism 600.

The stern-side fuel tank chamber 107, the stern-side engine room 101C, the bow-side engine room 102C, the first bow-side fuel tank chamber 103C, and the second bow-side fuel tank chamber 106 are sequentially arranged on the deck 4 inside the ship body 2 from the stern 2A side to the bow 2F side in the bow-stern direction FA.

The stern-side fuel tank chamber 107, the stern-side engine room 101C, the bow-side engine room 102C, the first bow-side fuel tank chamber 103C, the second bow-side fuel tank chamber 106 are respectively partitioned from each other by the transverse bulkheads 7 disposed at an interval in the bow-stern direction FA.

The stern-side engine room 101C internally has a first partitioned section 101Ca and a second partitioned section 101Cb which are two rooms partitioned in the bow-stern direction FA by a sub-bulkhead 7*s*. The sub-bulkhead 7*s* has fire protection performance and water-tightness which are the same as those of the transverse bulkhead 7.

The first partitioned section 101Ca internally accommodates the stern-side power generation unit 11.

The second partitioned section 101Cb accommodates a set tank 12 and a service tank 13 for temporarily storing the fuel supplied from fuel tank 31. The fuel supplied from the fuel tank 31 is fed to the set tank 12, and thereafter, the fuel is supplied to the stern-side power generation unit 11 via the service tank 13.

The bow-side engine room 102C is disposed between the first bow-side fuel tank chamber 103C and the stern side engine room 101C inside the ship body 2. The bow-side engine room 102C internally has a first partitioned section 1020*a* and a second partitioned section 102Cb which are two rooms partitioned into two in the bow-stern direction FA by the sub-bulkhead 7*s*.

The first partitioned section 102Ca internally accommodates the bow-side power generation unit 21.

The second partitioned section 102Cb accommodates a set tank 22 and a service tank 23 for temporarily storing the fuel supplied from the fuel tank 31. The fuel supplied from the fuel tank 31 is fed to the set tank 22, and thereafter, the fuel is supplied to the bow side power generation unit 21 via the service tank 23. A case of disposing the sub-bulkhead 7*s* is described as an example. However, the sub-bulkhead 7*s* may be omitted.

The first bow-side fuel tank chamber 103C is located on the bow 2F side in the bow-stern direction FA of the ship body 2 with respect to the stern-side engine room 101C and the bow-side engine room 102C. The first bow-side fuel tank chamber 103C internally accommodates the fuel tank 31. In this embodiment, a case where the two fuel tanks 31 are disposed in the first bow-side fuel tank chamber 103C has been described as an example. However, the number of the fuel tanks 31 is not limited to two.

The second bow-side fuel tank chamber 106 is located on the bow 2F side in the bow-stern direction FA of the ship body 2 with respect to the stern-side engine room 101C, the bow-side engine room 102C, and the first bow-tank chamber 103C. The second bow-side fuel tank chamber 106 internally accommodates the fuel tank 31. In this embodiment, a case where the two fuel tanks 31 are disposed in the second bow-side fuel tank chamber 106 has been described as an example. However, the number of the fuel tanks 31 is not limited to two.

The stern-side fuel tank chamber 107 is located on the stern 2A side in the bow-stern direction FA of the ship body 2 with respect to the stern-side engine room 101C and the bow-side engine room 102C. The stern-side fuel tank chamber 107 internally accommodates the fuel tank 31. In this embodiment, a case where the two fuel tanks 31 are disposed in the stern-side fuel tank chamber 107 has been described as an example. However, the number of the fuel tanks 31 is not limited to two.

The main fuel line 51C supplies the fuel stored in the fuel tank 31 inside the first bow-side fuel tank chamber 103C, the second bow-side fuel tank chamber 106, and the stern-side fuel tank chamber 107, to the stern-side engine room 101C and the bow-side engine room 102C. The main fuel line 51C is disposed so as to connect each of the fuel tanks 31 inside the first bow-side fuel tank chamber 103, the second bow-side fuel tank chamber 106, and the stern-side fuel tank chamber 107 to the stern-side power generation unit 11 and the bow-side power generation unit 21. In the main fuel line 51C, the first end portion 51*a* is branched and connected to each of the fuel tanks 31 inside the second bow-side fuel tank chamber 106. In the main fuel line 51C, the second end portion. 51*b* is branched and connected to each of the fuel tanks 31 inside the stern-side fuel tank chamber 107.

The main fuel line 51C penetrates each of the transverse bulkheads 7 and the sub-bulkhead 7*s* between the stern-side fuel tank chamber 107 and the second bow-side fuel tank chamber 106. In this manner, in the main fuel line 51C, the intermediate portion 51*c* disposed between the first end portion 51*a* and the second end portion 51*b* passes through the stern-side engine room 101C, the bow-side engine room 102C, and the first bow-side fuel tank chamber 103C.

The sub-fuel line 52C supplies the fuel stored in the fuel tank 31 mainly to the stern-side engine room 101C. In the sub-fuel line 52C, the first end portion 52*a* is connected to the fuel tank 31 inside the second bow-side fuel tank chamber 106.

The sub-fuel line 52C is located so that the intermediate portion 52*c* disposed between the first end portion 52*a* and the second end portion 52*b* passes through the partitioned section different from the bow-side engine room 102C through which the intermediate portion 51*c* of the main fuel line 51C passes and the first bow-side fuel tank chamber 103C, for example, the ship bottom partitioned section 108. The ship bottom partitioned section 108 is formed between the deck 4 and the ship bottom 2*b* inside the ship body 2. The ship bottom partitioned section 108 is separated from the bow-side engine room 102C, the stern-side engine room 101C, the first bow-side fuel tank chamber 103C by the bulkhead 18 having fire protection performance and water-tightness.

The pump mechanism 60C includes each of pumps 61C, 66C, and 67C and each of on-off valves 65 and 68.

The pump (first pump) 61C is disposed inside the first bow-side fuel tank chamber 103C. The pump 61C feeds the fuel from the fuel tank 31 inside the first bow-side fuel tank chamber 103C via the main fuel line 51C.

The pump (the second pump) 66C is disposed inside the second bow-side fuel tank chamber 106. The pump 66C feeds the fuel from the fuel tank 31 inside the second bow-side fuel tank chamber 106 via the sub-fuel line 52C.

The pump 67C is disposed inside the stern-side fuel tank chamber 107. The pump 66C feeds the fuel from the fuel tank 31 inside the stern-side fuel tank chamber 107 via the main fuel line 51C.

The on-off valve 65 is disposed in the main fuel line 51C. The on-off valves 65 are respectively located on both sides of the transverse bulkhead 7 or the sub-bulkhead 7*s* across a position where the main fuel line 51C penetrates the transverse bulkhead 7 or the sub-bulkhead. 7*s*.

The on-off valve 68 is disposed in the sub-fuel line 52C. The on-off valves 68 are respectively disposed inside the second bow-side fuel tank chamber 106 and the stern-side engine room 101C. The on-off valves 68 are respectively located in the vicinity of a portion where the sub-fuel line 52C penetrates the bulkhead 18.

The pump mechanism 60C configured in this way switches operations of the pumps 61C, 66C, and 67C and opening and closing of the on-off valves 65 and 68. In this manner, the pump mechanism 60C can selectively feed the fuel from the fuel tank 31 to either the main fuel line 51C or the sub-fuel line 52C.

During normal navigation, the ship 1 configured in this way brings the pump 66C of the sub-fuel line 52C into a stopped state and each of the on-off valves 68 into a closed state. In a state where the pump 61C is operated, each of the on-off valves 65 is open. In this manner, as illustrated by a thick line in FIG. 5, the fuel stored in the fuel tank 31 inside the first bow-side fuel tank chamber 103C and the fuel tank 31 of the second bow-side fuel tank chamber 106 can be supplied to the bow-side engine room 102C through the main fuel line 51C. Furthermore, the pump 67C is operated so that the fuel can be supplied from the fuel tank 31 inside the stern-side fuel tank chamber 107 to the stern-side engine room 101C through the main fuel line 51C.

In the ship 1 according to the third embodiment, in a case where there is a fire or a flood in any one of the bow-side engine room 102C and the first bow-side fuel tank chamber 103C, the on-off valve 65 of the main fuel line 51C is closed, and the pump 61C is stopped at a position as close as possible outside the partitioned section where there are the fire and the flood. Furthermore, the on-off valve 68 is open, and the pump 66C operated. Then, as illustrated by a thick line in FIG. 6, the fuel can be supplied from the fuel tank 31 inside the second bow-side fuel tank chamber 106 to the stern-side engine room 101C through the sub-fuel line 52C.

According to the ship 1 of the above-described third embodiment, the sub-fuel line 52C is configured to pass through the ship bottom partitioned section 108 different from the bow-side engine room 102C and the first bow-side fuel tank chamber 103C through which the main fuel line 51C passes, between the second bow-side fuel tank chamber 106 and the stern-side engine room 101C. In this manner, even if there is a fire or a flooding in the first bow-side fuel tank chamber 103C or the bow-side engine room 102C through which the main fuel line 51C passes, the fuel can be supplied to the stern-side power generation unit 11 disposed in the stern-side engine room 101C through the sub-fuel line 52C. According to this configuration, the ship 1 can continuously perform the self-navigation.

The sub-fuel line 52C passes through the ship bottom partitioned section 108 adjacent below the bow-side engine room 102C. According to this configuration, it is possible to minimize the length of the sub-fuel line 52C by preventing the sub-fuel line 52C from taking a roundabout route.

In this way, the sub-fuel line 52C passes through the ship bottom partitioned section 108. Accordingly, it is possible to prevent a possibility that the sub-fuel line 52C may affect a cargo space on the deck 4 inside the ship body 2 or a space for installing various devices. In this manner, the space inside the ship body 2 can be effectively utilized.

Furthermore, the first bow-side fuel tank chamber 103C and the second bow-side fuel tank chamber 106 are disposed separate from each other. In this manner, even if there is a fire or a flood in the first bow-side fuel tank chamber 103C or the second bow-side fuel tank chamber 106, the fuel supply is not interrupted. Therefore, the ship 1 can continuously perform the self-navigation.

Furthermore, the main fuel line 51C includes the on-off valves 65 on both sides of the transverse bulkhead 7 and the sub-bulkhead 7*s* through which the main fuel line 51C penetrates. According to this configuration, the on-off valve 65 is closed in the partitioned section other than the partitioned section where there is the fire. In this manner, it is possible to prevent the fuel from being supplied into the main fuel line 51C passing through the partitioned section where there is the fire.

First Modification Example of Third Embodiment

Figure 7:
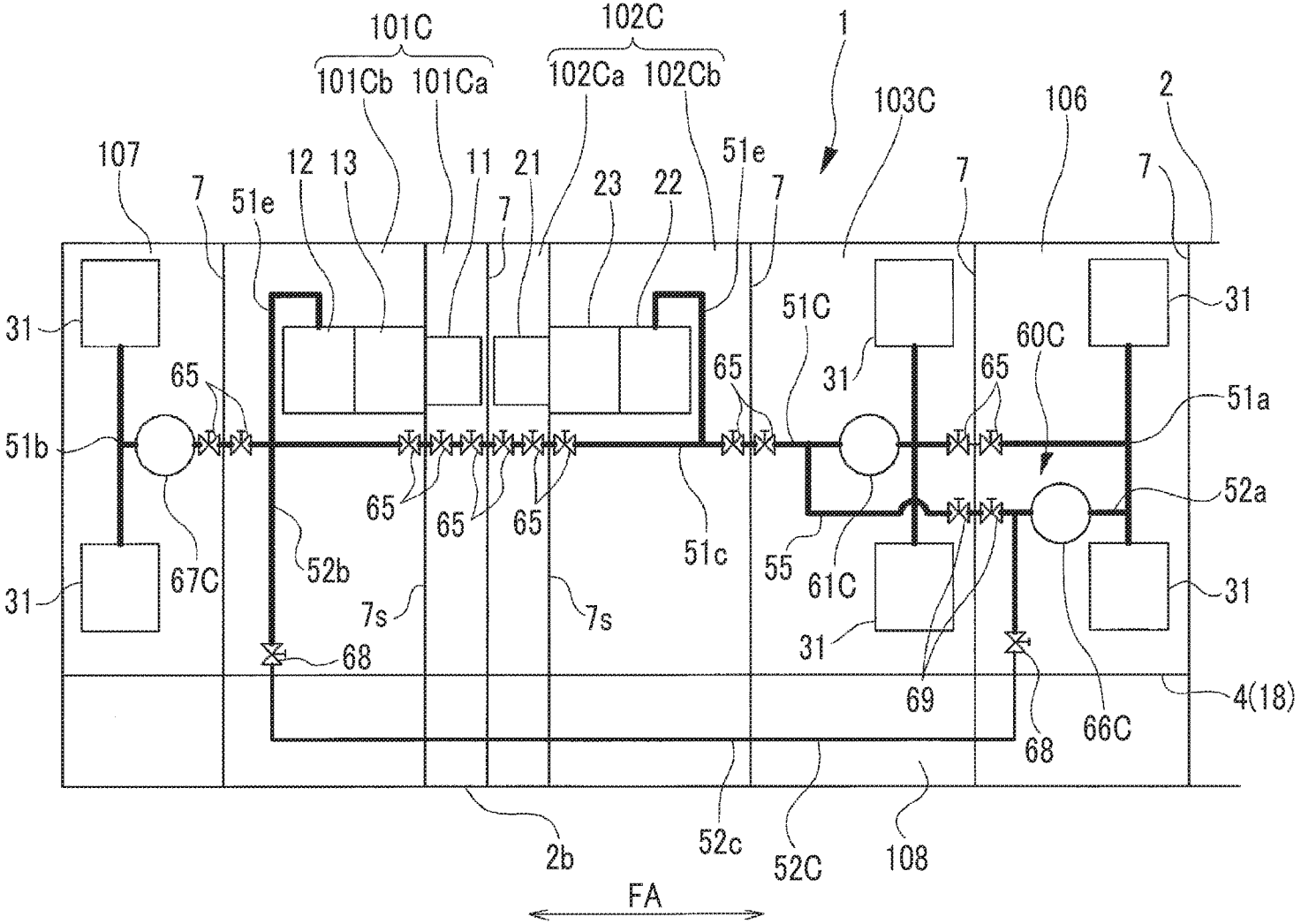
FIG. 7 is a block diagram illustrating a configuration of a ship according to a first modification example of the third embodiment of this invention.

FIG. 7 is a block diagram illustrating a configuration of the ship according to a first modification example of the third embodiment of this invention.

In the above-described configuration of the third embodiment, for example, a bypass line 55 can be disposed as illustrated in FIG. 7. The bypass line 55 connects the main fuel line 51C and the sub-fuel line 52C to each other. The bypass line 55 is connected to the main fuel line 51C inside the first bow-side fuel tank chamber 103C, and is connected to the sub-fuel line 52C inside the second bow-side fuel tank chamber 106.

In this case, on-off valves 69 are disposed in the bypass line 55. The on-off valves 69 are respectively arranged on both sides of the transverse bulkhead 7, across a position where the bypass line 55 penetrates the transverse bulkhead 7, between the first bow-side fuel tank chamber 103C and the second bow-side fuel tank chamber 106.

In the ship 1 configured in this way, in a case where the pump 61C fails during normal navigation, the pump 66C is operated, and the on-off valve 69 is open. As illustrated by a thick line in FIG. 7, the fuel can be supplied from the fuel tank 31 inside the second bow-side fuel tank chamber 106 to the bow-side engine room 102C via the bypass line 55 and the main fuel line 51C.

Second Modification Example of Third Embodiment

In the first modification example according to the above-describe third embodiment, the stern-side fuel tank chamber 107 is located adjacent to the stern side of the stern-side engine room 101C. However, the stern-side fuel tank chamber 107 may be omitted as in a second modification example according to the third embodiment which will be described in detail below.

Figure 8:
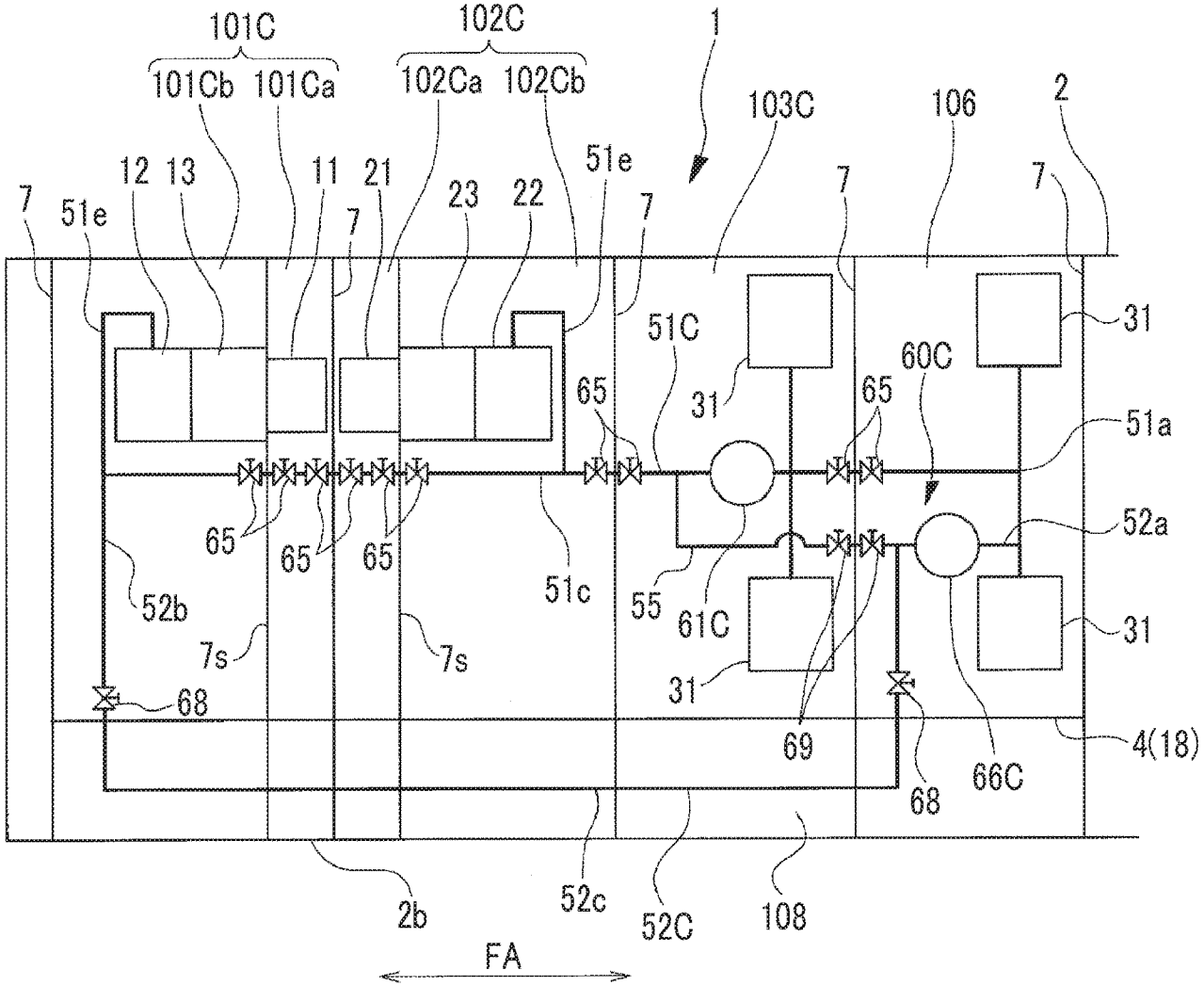
FIG. 8 is a block diagram illustrating a configuration of a ship according to a second modification example of the third embodiment of this invention.
Figure 9:
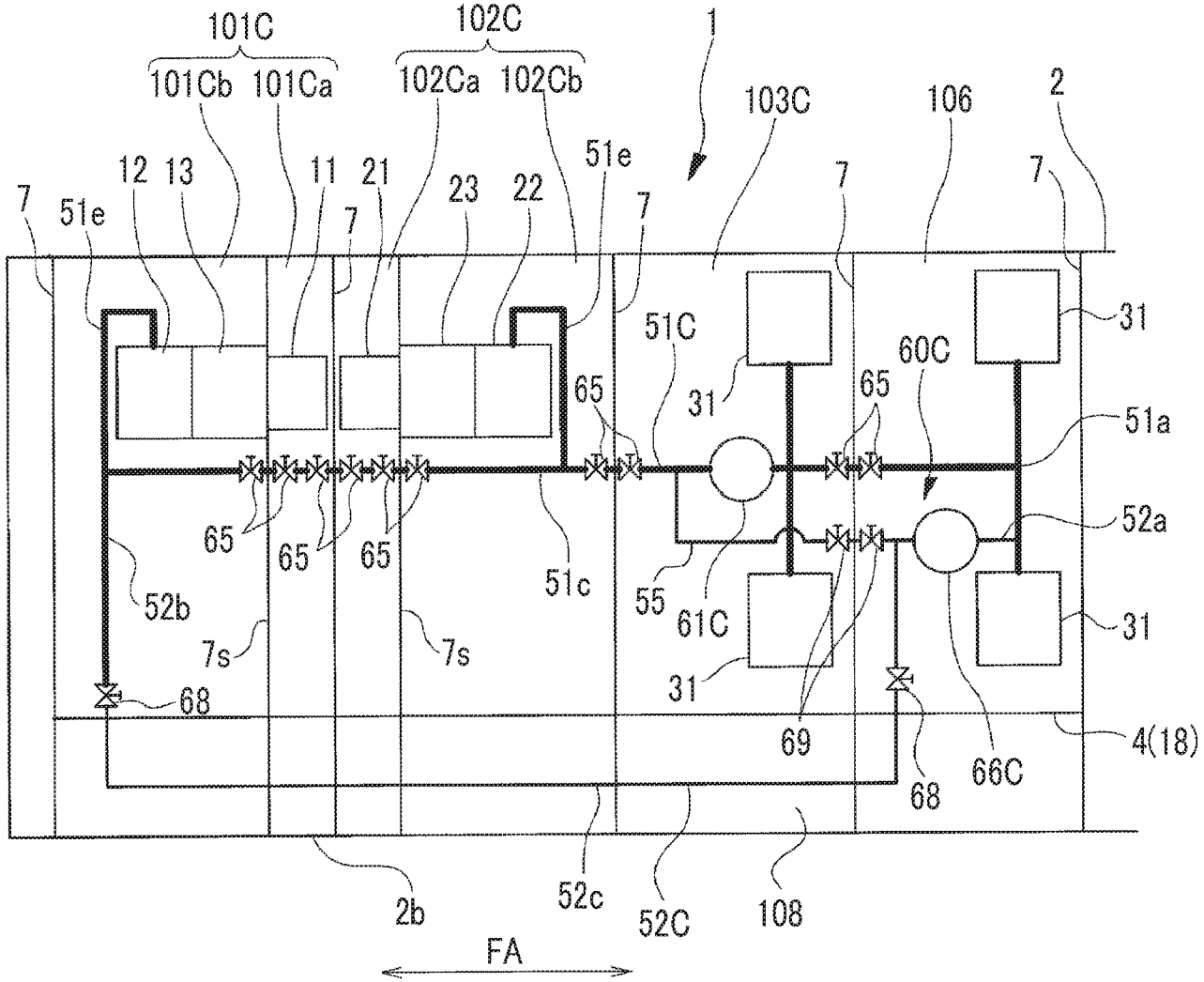
FIG. 9 is a view illustrating a state where the fuel is supplied through a main fuel line of the ship according to the second modification example of the third embodiment of this invention.
Figure 10:
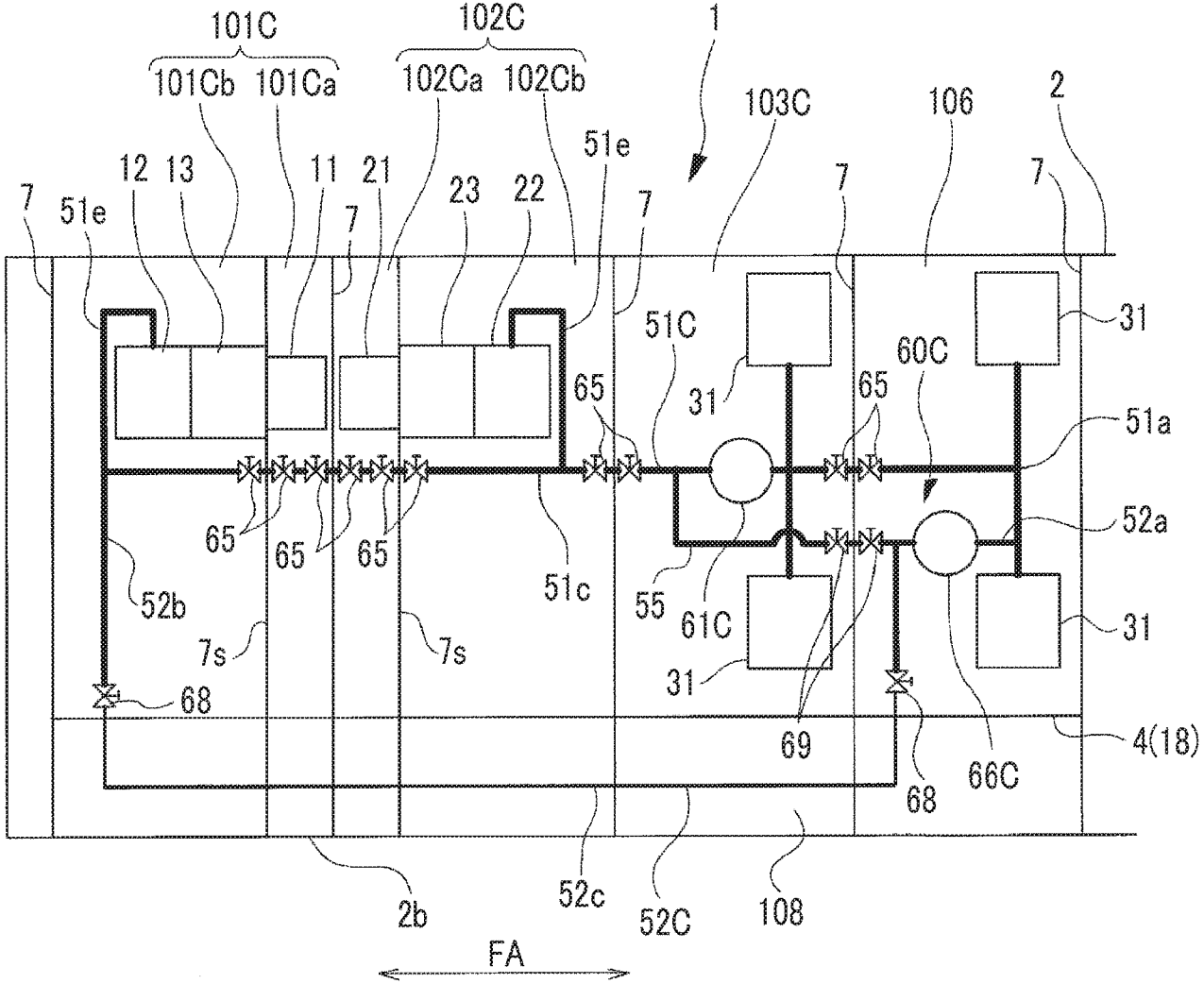
FIG. 10 is a view illustrating a state where the fuel is supplied using the main fuel line of the ship and a bypass line according to the second modification example of the third embodiment of this invention.
Figure 11:
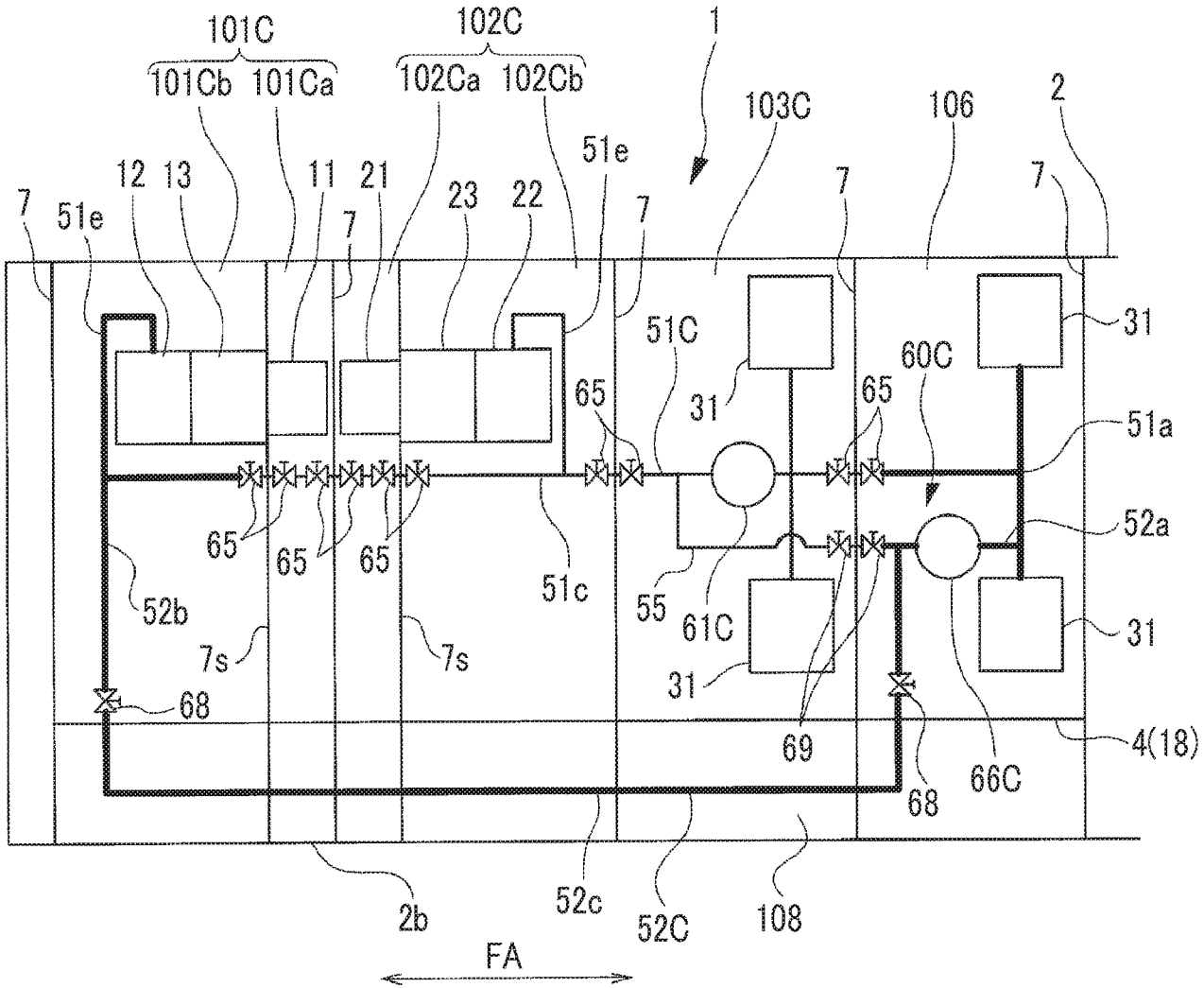
FIG. 11 is a view illustrating a state where the fuel is supplied through a sub-fuel line of the ship according to the second modification example of the third embodiment of this invention.

FIG. 8 a block diagram illustrating a configuration of the ship according to the second modification example of the third embodiment of this invention. FIG. 9 is a diagram illustrating a state where the fuel is, supplied through the main fuel line of the ship according to the second modification example of the above-described third embodiment. FIG. 10 is a diagram illustrating a state where the fuel is supplied using the main fuel line and the bypass line of the ship according to the second modification example of the above-described third embodiment. FIG. 11 is a diagram illustrating a state where the fuel is supplied through the sub-fuel line of the ship according to the second modification example of the above-described third embodiment.

As illustrated in FIG. 8, similar to the first modification example of the above-described third embodiment, the ship according to the second modification example of the third embodiment includes the ship body 2, the stern-side engine room (first engine room) 101C, the bow-side engine room (second engine room) 102C, the first bow-side fuel tank chamber (first fuel tank chamber) 103C, the second bow-side fuel tank chamber (second fuel tank chamber) 106, the main fuel line (first fuel line) 51C, the sub-fuel line (second fuel line) 52C, the bypass line 55, and the pump mechanism 60C. On the other hand, the stern-side fuel tank chamber 107 of the ship 1 according to the first modification example of the above-described third embodiment is not provided.

The ship body 2, the stern-side engine room (first engine room) 101C, the bow-side engine room (second engine room) 102C, the first bow-side fuel tank chamber (first fuel tank chamber) 103C, the second bow-side fuel tank chamber (second fuel tank chamber) 106, the main fuel line (first fuel line) 51C, the sub-fuel line (second fuel line) 52C, the bypass line 55, the pump mechanism 60C, and the pump 61C respectively have configurations the same as those according to the first modification example of the above-described third embodiment, and thus, detailed description thereof will be omitted.

Similar to the first modification example of the third embodiment, in the ship 1 according to the second modification example of the third embodiment during normal navigation, the pump 66C of the sub-fuel line 52C is stopped, and each of the on-off valves 68 closed, thereby operating the pump 61C. In this manner, as illustrated by a thick line in FIG. 9, the fuel stored in the fuel tank 31 inside the first bow-side fuel tank chamber 103C and the fuel tank 31 inside the second bow-side fuel tank chamber 106 is supplied to the bow-side engine room 102C and the stern-side engine room 101C through the main fuel line 51C.

In a case where the pump 61C fails, the pump 66C is operated, and the on-off valve 69 is open. As illustrated by a thick line in FIG. 10, the fuel can be supplied from the fuel tank 31 inside the second bow-side fuel tank chamber 106 to the bow-side engine room 102C via the bypass line 55 and the main fuel line 51C.

Furthermore, in a case where there is a fire or a flood in any one of the bow-side engine room 102C and the first bow-side fuel tank chamber 103C, the on-off valve 65 of the main fuel line 51C is closed, and the pump 61C is stopped at a position as close as possible outside the partitioned section where there is the fire or the flood. Furthermore, the on-off valve 68 is open, and the pump 66C is operated. Then, as illustrated by a thick line in FIG. 11, the fuel can be supplied from the fuel tank 31 inside the second bow-side fuel tank chamber 106 to the stern-side engine room 101C through the sub-fuel line 52C.

According to the ship 1 in the second modification example of the above-described third embodiment, the sub-fuel line 52C is configured to pass through ship bottom partitioned section 108 different from the bow-side engine room 102C and the first bow-side fuel tank chamber 103C through which the main fuel line 51C passes, between the second be fuel tank chamber 106 and the stern-side engine room 101C. In this manner, even if there is the fire or the flood in the first bow-side fuel tank chamber 103C or the bow-side engine room 102C through which the main fuel line 51C passes, the fuel can be supplied to the stern-side power generation unit 11 disposed in the stern side engine room 101C through the sub-fuel line 52C. According to this configuration, the ship 1 can continuously perform the self-navigation.

Furthermore, the first bow-side fuel tank chamber 103C and the second bow-side fuel tank chamber 106 are located on the bow 2F side of the stern-side engine room 101C and the bow-side engine room 102C. In this manner, it is no longer necessary to dispose the fuel tank chamber on the stern 2A side. According to is configuration, compared to a case where the fuel tank chamber is disposed on the stern 2A side which is likely to receive space restrictions, the larger fuel tank 31 can be installed in the first bow-side fuel tank chamber 103C and the second bow-side fuel tank chamber 106.

Furthermore, the fuel tank chamber 107 is not disposed on the stern 2A side from the stern-side engine room 1010. Accordingly, the center of gravity of the ship body 2 in the bow-stern direction FA can be prevented from being biased toward the stern 2A side. In this manner, it is no longer necessary to dispose ballast on the bow 2F side in order to keep a balance in the bow-stern direction FA of the ship body 2. As a result, it is possible to prevent the ship body 2 from increasing in weight, and thus, it is possible to contribute to improved fuel efficiency of the ship 1.

Furthermore, the fuel tank chamber 107 is not disposed on the stern 2A side of the stern-side engine room 101C. Accordingly, the first bow-side fuel tank chamber 103C, the second bow-side fuel tank chamber 106, the stern-side engine room 101C, and the bow-side engine room 102C can be laid out close to the stern 2A side. In this manner, a space on the bow 2F side from the second bow-side fuel tank chamber 106 inside the ship body 2 can be effectively utilized as a larger cargo space.

Furthermore, the sub-fuel line 52C passes through the ship bottom partitioned section 108 adjacent below the bow-side engine room 102C. According to this configuration, it is possible to minimize the length of the sub-fuel line 52C by preventing the sub-fuel line 52C from taking a roundabout route.

Furthermore, the sub-fuel line 52C passes through the ship bottom partitioned section 108. Accordingly, it is possible to prevent a possibility that the sub-fuel line 52C may cause damage to a cargo space on the deck 4 inside the ship body 2 or a space for installing various devices. In this manner, the space inside the ship body 2 can be effectively utilized.

Furthermore, the first bow-side fuel tank chamber 103C and the second bow-side fuel tank chamber 106 are disposed separate from each other. In this manner, even if there is a fire or a flood in the first bow-side fuel tank chamber 103C or the second bow-side fuel tank chamber 106, the fuel supply is not interrupted. Therefore, the ship 1 can continuously perform the self-navigation.

The main fuel line 51C has the on-off valves 65 disposed on both sides across a position where the main fuel line 51C penetrates the transverse bulkhead 7. Therefore, the on-off valve 65 is closed in the partitioned section adjacent to the partitioned section where there is the fire. In this manner, it is possible to prevent the fuel from being supplied to the partitioned section where there is the fire after passing through the main fuel line 51C.

In the above-described third embodiment, the stern-side engine room 101C and the bow-side engine room 102C are internally partitioned into the first partitioned sections 101Ca and 102Ca and the second partitioned sections 101Cb and 102Cb by the sub-bulkhead 7*s*. However, this invention is not limited thereto. The sub-bulkhead 7*s* and the on-off valves 65 on both sides of the sub-bulkhead 7*s* may be omitted. The stern-side engine room 101C and the bow-side engine room 102C may be respectively formed using one partitioned section.

In the above-described third embodiment, the set tanks 12 and 22 and the service tanks 13 and 23 for temporarily storing the fuel supplied from the fuel tank 31 are provided. However, only the service tanks 13 and 23 may be provided.

Other Modification Examples

This invention is not limited to the above-described embodiments, and includes various modifications of the above-described embodiments within the scope not departing from the gist of this invention. That is, the specific and configurations which are described in the embodiments are merely examples, and can be appropriately modified.

For example, in the above-described respective embodiments, a plurality of the stern-side power generation units 11 and the bow-side power generation units 21 may be accommodated in the stern-side engine rooms 101 and 101C and the bow-side engine rooms 102 and 102C.

In the first and third embodiments and the respective modification examples, the fuel tank 31 and the pumps 61, 61C, 66C, and 67C are accommodated in the fuel tank chamber 103, the first bow-side fuel tank chamber 103C, the second bow-side fuel tank chamber 106, anal the stern-side fuel tank chamber 107. However, this invention is not limited thereto. For example, only the fuel tank 31 may be accommodated in the fuel tank chamber 103, the first bow-side fuel tank chamber 103C, the second bow-side fuel tank chamber 106, and the stern-side fuel tank chamber 107. A pump room for accommodating the pumps 61, 61C, 66C, and 67C may be provided.

In the above-described embodiments, the electric motor M is used as the propeller 6. The stern-side power generation unit 11 and the bow-side power generation unit which generate the driving force for rotationally driving the electric motor M are accommodated in the stern-side engine rooms 101 and 101C and the bow-side engine rooms 102 and 102C. However, this invention is not limited thereto. In a case where a combustion engine such as a gas turbine and an engine is used as a main machine for directly and rotationally driving the screw 5, the combustion engine may be accommodated in the stern-side engine rooms 101 and 101C and the bow-side engine rooms 102 and 102C. The fuel may be supplied to the combustion engine such as the gas turbine and the engine through the main fuel lines 51 and 51C and the sub-fuel lines 52 and 52C.

A configuration may be adopted in which the propeller 6 and the main machine are combined with each other as a propulsion source of the ship 1.

In the above-described respective embodiments, the internal combustion engine unit such as the gas turbine and the diesel engine is provided as the combustion engine. However, an external combustion engine such as a steam turbine may be provided as the combustion engine.

The sub-fuel lines 52 and 52C are configured to pass through the ship bottom partitioned section 108. However, this invention is not limited thereto. For example, the sub-fuel line 52 may pass through the partitioned section the same as the main fuel line 51 by being inserted into the partitioned section inside a duct which is partitioned by a tubular duct having predetermined fire protection performance and water-tightness.

In the above-described embodiments, a case has been described which includes the two engine rooms (for example, the stern-side engine room 101 and the bow-side engine room 102) and the two bow-side fuel tank chambers (for example, the first bow-side fuel tank chamber 103C and the second bow-side fuel tank chamber 106). However, the engine room and the bow-side fuel tank chamber may be respectively disposed by being partitioned into three or more.

INDUSTRIAL APPLICABILITY

This invention is applicable to a ship having a plurality of fuel lines. According to this invention, even if there is a fire or a flood, the ship can perform self-navigation, and a space inside a ship body can be effectively utilized.

REFERENCE SIGNS LIST

1: ship
2: ship body
2*b*: ship bottom
2F: bow
2A: stern
2*s*: ship side
3: freeboard deck
4: deck
5: screw
6: propeller
7: transverse bulkhead (bulkhead)
7A, 7B: transverse bulkhead
7*s*: sub-bulkhead

11: stern-side power generation unit (first combustion engine)
12: set tank
13: service tank
18: bulkhead
21: bow-side power generation unit (second combustion engine)
22: set tank
23: service tank
31: fuel tank
51, 51C: main fuel line (first fuel line)
51*a*: first end portion
51*b*: second end portion
51*c*: intermediate portion
51*d*: branch pipe
52, 52B, 52C: sub-fuel line (second fuel line)
52*a*: first end portion
52*b*: second end portion
52*c*: intermediate portion
55: bypass line
60, 60B, 60C: pump mechanism
61, 61C: pump (first pump)
62, 66C: pump (second pump)
63: on-off valve
63B: on-off valve
64: on-off valve
64B: on-off valve
65: on-off valve
67C: pump
68: on-off valve
69: on-off valve
101, 101C: stern-side engine room (first engine room)
101Ca: first partitioned section
101Cb: second partitioned section
102, 102C: bow-side engine room (second engine room)
102Ca: first partitioned section
102Cb: second partitioned section
103: fuel tank chamber
103C: first bow-side fuel tank chamber (first fuel tank chamber)
104: partitioned section
105: partitioned section
106: second bow-side fuel tank chamber (second fuel tank chamber)
107: stern-side fuel tank chamber
108: ship bottom partitioned section
FA: bow-stern direction
M: electric motor

The invention claimed is:

1. A ship having a plurality of fuel lines, the ship comprising:

a ship body;

a fuel tank chamber disposed inside the ship body, and partitioned by a bulkhead so as to accommodate a fuel tank;

a first engine room disposed inside the ship body, and partitioned by the bulkhead so as to accommodate a first combustion engine for combusting a fuel supplied from the fuel tank;

a second engine room disposed between the fuel tank chamber and the first engine room inside the ship body, and partitioned by the bulkhead so as to accommodate a second combustion engine for combusting the fuel supplied from the fuel tank;

a first fuel line connecting the fuel tank to the first combustion engine and the second combustion engine through the second engine room;

a second fuel line connecting at least the fuel tank and the first combustion engine to each other, and located through a partitioned section different from the second engine room through which the first fuel line passes; and a pump mechanism for selectively feeding the fuel from the fuel tank to either the first fuel line or the second fuel line.

2. The ship having a plurality of fuel lines according to claim 1, wherein the pump mechanism includes a first pump disposed in the first fuel line and a second pump disposed in the second fuel line, and wherein the first pump and the second pump are arranged in mutually different partitioned sections.

3. The ship having a plurality of fuel lines according to claim 1, wherein the fuel tank chamber includes a first fuel tank chamber and a second fuel tank chamber which are partitioned by the bulkhead so as to respectively accommodate the fuel tanks, and wherein the first fuel line is connected to the fuel tank disposed in the first fuel tank chamber out of the first fuel tank chamber and the second fuel tank chamber, and the second fuel line is connected to the fuel tank disposed in the second fuel tank chamber.

4. The ship having a plurality of fuel lines according to claim 1, wherein the fuel tank chamber is located on a bow side in a bow-stern direction of the ship body with respect to the second engine room.

5. The ship having a plurality of fuel lines according to claim 1, wherein the first fuel line includes on-off valves disposed on both sides across a position where the first fuel line penetrates the bulkhead.

6. The ship having a plurality of fuel lines according to claim 1, wherein the second fuel line is located so as to pass through the partitioned section adjacent to the second engine room in a ship width direction or an upward-downward direction of the ship body.

7. The ship having a plurality of fuel lines according to claim 6, wherein the second fuel line is located so as to pass through the fuel tank chamber, the first engine room, and a ship bottom partitioned section formed below the second engine room.

* * * * *